252-99. AU 165 EX
1-13-76 XR 3,932,295

United States Patent [19]

Fujino et al.

[11] 3,932,295

[45] Jan. 13, 1976

[54] DETERGENT COMPOSITION

[75] Inventors: Takashi Fujino, Yokohama; Riyouichi Matsui, Sakura, both of Japan

[73] Assignee: Kao Soap Co., Ltd., Tokyo, Japan

[22] Filed: Apr. 29, 1974

[21] Appl. No.: 465,066

[52] U.S. Cl. .... 252/102; 252/DIG. 2; 252/DIG. 15; 252/97; 252/98; 252/99

[51] Int. Cl.[2] ..... C11D 7/54

[58] Field of Search ..... 252/102, 97, 98, 99, 186, 252/DIG. 2, DIG. 15

[56] References Cited

UNITED STATES PATENTS

| | | | |
|---|---|---|---|
| 3,318,816 | 5/1967 | Trowbridge | 252/DIG. 15 |
| 3,689,435 | 9/1972 | Berni et al. | 252/DIG. 15 |
| 3,847,830 | 11/1974 | Williams et al. | 252/102 |

OTHER PUBLICATIONS

"Book" Special Functions Surfactants, pp. 306–307.

"PVP" Antara Chemicals, 4/60, p. 29.

*Primary Examiner*—Mayer Weinblatt
*Attorney, Agent, or Firm*—Woodhams, Blanchard and Flynn

[57] ABSTRACT

A bleaching detergent composition comprising a percarbonate and polyethylene glycol or polyvinyl pyrrolidone or a mixture thereof.

3 Claims, No Drawings

DETERGENT COMPOSITION

BACKGROUND OF THE INVENTION

1. Field of the Invention

The present invention relates to a detergent composition for washing different textile goods, particularly plain or figured colored fabrics together with white textile goods in the same washing bath with a minimal color migration to white textile goods while preserving the fresh and distinct colors and patterns of the colored fabrics.

2. Description of the Prior Art

In European countries, sodium perborate has heretofore been employed as an oxidizing type mild bleaching agent that presents no risk of fading or discoloring plain or figured colored fabrics. In Japan, however, where hotwater washing is not popular and clothes washing is generally carried out at low temperatures, sodium perborate when mixed with detergent compositions has little effect. The employment of a large quantity of sodium perborate has caused the pollution of rivers and irrigated fields by boron compounds so that the toxicity thereof to vegetables is becoming an important object of discussion.

Under these circumstances, pertinent substitutes for sodium perborate were searched for and, as a result, sodium percarbonate has become noteworthy. Though sodium percarbonate is better in its low temperature solubility and its bleaching capacity than sodium perborate, the detergent composition mixed with sodium percarbonate has the defect that it promotes the migration of dyestuffs released from color fabrics to white fabrics. That is why color fabrics must be washed separately from white fabrics.

SUMMARY OF THE INVENTION

The object of the present invention is to provide a bleaching detergent composition which permits the alkali metal percarbonates, such as sodium and potassium, to display a bleaching effect without causing color migration from the plain or figured color fabrics to white fabrics in the same washing bath.

The bleaching detergent composition of the present invention comprises an alkali metal percarbonate together with polyethylene glycol or polyvinyl pyrrolidone or a mixture thereof.

The polyethylene glycol used in the detergent composition of the present invention must have a molecular weight higher than 4,000, but the upper limit of the molecular weight is not particularly limited. A preferable range of the molecular weight is 4,000–20,000.

As regards polyvinyl pyrrolidone, the molecular weight is not particularly limited. Though all the commercially available products can be used, the preferable range of its molecular weight is 40,000–360,000.

The percarbonates are usually employed in the amount within the range of about 1–50% by weight based on the detergent composition, and polyethylene glycol, polyvinyl pyrrolidone or a mixture thereof is employed in the amount of 0.01–10 times as much as the amount of the percarbonate.

The detergent composition of the present invention contains, in addition to the percarbonate and polyethylene glycol or polyvinyl pyrrolidone, at least one known active detergent component, that is, a surfactant. As surfactants, there can be mentioned, for example, anionic surfactants such as sodium alkyl sulfates of 10 to 20 carbon atoms, sodium salts of higher fatty acids of 10 to 20 carbon atoms, sodium salts of olefinsulfonates of 10 to 20 carbon atoms, sodium alkylbenzenesulfonates containing an alkyl group of 10 to 20 carbon atoms, sodium salts of polyoxyethylene alkyl ether sulfuric esters containing an alkyl group of 10 to 20 carbon atoms and sodium salts of polyoxyethylene alkylphenyl ether sulfuric esters containing an alkyl group of 6 to 10 carbon atoms; or nonionic surfactants such as polyoxyethylene alkyl ethers containing an alkyl group of 10 to 20 carbon atoms and polyoxyethylene alkylphenyl ethers containing an alkyl group of 6 to 10 carbon atoms.

Further, if necessary, a neutral or alkaline inorganic or organic builder or other additives can be incorporated therein. As the neutral or alkaline inorganic builders, there can be mentioned, for example, sodium sulfate, sodium carbonate, sodium bicarbonate, polyphosphates such as sodium pyrophosphate and sodium tripolyphosphate and various sodium silicates having the general formula of $Na_2O.nSiO_2$ ($n$=1, 2, 2.5). As the organic builders, there can be mentioned nitrilotriacetates, ethylenediamine tetraacetates and citric acid salts.

As other additives, there can be mentioned carboxymethyl cellulose, sodium sulfate (Glauber's salt), fluorescent whitening agents and perfumes.

It will be understood that the adjuncts used in the bleaching detergent composition of the invention can be selected from among those conventionally used for this purpose in accordance with conventional practice. Since the present invention does not concern any discovery relating to such adjuncts, further description of them is believed unnecessary.

The present invention will be further described by reference to the following illustrative examples, wherein "parts" refers to parts by weight.

EXAMPLE 1

The detergent composition (1) consisting of the components as shown in the following table was prepared and, by using this detergent composition (1), the detergent compositions A–F shown in Table I was prepared by incorporating various components in Table I into said composition (1). By employing these detergent compositions, a white nylon cloth or white cotton cloth and a figured color cloth were washed in the same bath under the washing conditions as shown below.

| Detergent Composition (1) | wt.% |
|---|---|
| Sodium alkylbenzenesulfonate | 20% |
| Sodium tripolyphosphate | 25% |
| Sodium silicate | 5% |
| Sodium silicate | 5% |
| Sodium salt of coconut oil fatty acid | 1% |
| Fluorescent whitening agent | 0.5% |
| Perfume | 0.1% |
| Water | 10% |
| Sodium sulfate | 36.4% |

Washing Conditions

| | |
|---|---|
| Concentration of detergent composition | 0.2% by wt. |
| Washing temperature | 30°C |
| Washing period | 10 min. |
| Rinsing | once for every 3 min. |
| Bath ratio | 1/50 |

The test was repeated 3 times. The washing results were evaluated by naked eye and also by the determination of *b* value with a colorimeter (the smaller is *b*-value, the better). The obtained results are shown in Table II.

Table I

| Detergent Composition | Comparative examples | | | | Examples of the present Invention | |
|---|---|---|---|---|---|---|
| Components | A | B | C | D | E | F |
| Detergent | wt.% | | | | | |
| Composition (1) | 100 | 80 | 80 | 85 | 80 | 80 |
| Sodium perborate | — | 15 | — | — | — | — |
| Sodium percarbonate | — | — | 15 | 15 | 15 | 15 |
| Polyethylene glycol (Molecular weight = 6,000) | — | — | — | — | 5 | — |
| Carboxymethyl-cellulose | — | 5 | 5 | — | — | — |
| Polyvinylpyrrolidone (Molecular weight = 360,000) | — | — | — | — | — | 5 |

Table II

| Detergent Composition | Comparative examples | | | | Examples of the present Invention | |
|---|---|---|---|---|---|---|
| Evaluation | A | B | C | D | E | F |
| Nylon white cloth | | | | | | |
| Evaluation by naked eye* | ± | + | − | − | + | ++ |
| b-value | 1.3 | 0.1 | 1.8 | 2.3 | 0.3 | 0.6 |
| Cotton white cloth | | | | | | |
| Evaluation by naked eye* | ± | + | ± | + | ++ | ++ |
| b-value | −0.6 | 0.9 | −0.7 | 1.0 | −1.4 | −1.8 |

Note: *Evaluation by naked eye
± : standard
+ : better than standard
++: much better than standard
− : not good (migration is found)

As will be apparent from the above Tables, when the washing is carried out by employing the detergent compositions E and F of the present invention, the color pattern is clean and bright, and no migration toward the white fabric is seen.

EXAMPLE 2

Tests were conducted according to a method similar to Example 1 and by employing polyethylene glycol and polyvinyl pyrrolidone of different molecular weights (M.W.). The results of washing tests with nylon white cloth and figured color clothes in the same bath are shown in Table III.

Detergent composition of this invention:

| | | |
|---|---|---|
| Detergent composition (1) of Example 1 | 80% | by wt. |
| Sodium percarbonate | 15 | " |
| Polymer (Polyethylene glycol or polyvinyl pyrrolidone) | 5 | " |

Detergent composition for comparison:

| | | |
|---|---|---|
| Detergent composition (1) of Example 1 | 85% | by wt. |
| Sodium percarbonate | 15 | " |

Table III

| Polymer | Polyethylene glycol | | | | Polyvinyl pyrrolidone | | Detergent composition for Comparison |
|---|---|---|---|---|---|---|---|
| M.W. | 1,500 | 4,000 | 6,000 | 20,000 | 40,000 | 360,000 | |
| Evaluation | | | | | | | |
| By naked eye* | − | + | + | + | ++ | ++ | − |
| b-value | 1.3 | 0.5 | 0.3 | 0.4 | −0.6 | 1.3 | |

Note: *The same as the Note for Table II.

The embodiments of the invention in which an exclusive property or privilege is claimed are defined as follows:

1. A bleaching detergent composition consisting essentially of an anionic or nonionic textile-washing surfactant; from 1 to 50% by weight of sodium percarbonate; and a polymer selected from the group consisting of polyethylene glycol having a molecular weight in the range of 4000 to 20000, polyvinylpyrrolidone having a molecular weight in the range of 40000 to 360000, and mixtures thereof, the amount of said polymer being from 0.01 to 10 times the amount of sodium percarbonate, whereby the composition in aqueous solution is effective to remove soil from textiles and bleach the textiles and said polymer is effective to reduce migration of dyestuffs from colored textiles to white textiles present in the same washing bath.

2. A bleaching composition as claimed in claim 1, in which said polymer consists of said polyethylene glycol.

3. A bleaching composition as claimed in claim 1, in which said polymer consists of said polyvinylpyrrolidone.

* * * * *